US007751578B2

(12) United States Patent
Arz et al.

(10) Patent No.: US 7,751,578 B2
(45) Date of Patent: Jul. 6, 2010

(54) HEARING DEVICE REMOTE CONTROL UNIT AS A NETWORK COMPONENT AND CORRESPONDING USE THEREOF

(75) Inventors: Winfried Arz, Nürnberg (DE); Thomas Fischer, Erlangen (DE); Thomas Lotter, Nürnberg (DE); Gottfried Rückerl, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1100 days.

(21) Appl. No.: 11/416,496

(22) Filed: May 2, 2006

(65) Prior Publication Data

US 2006/0245609 A1 Nov. 2, 2006

(30) Foreign Application Priority Data

May 2, 2005 (DE) ..... 10 2005 020 315

(51) Int. Cl.
*H04R 25/00* (2006.01)

(52) U.S. Cl. ..... 381/315; 381/312

(58) Field of Classification Search ..... 381/23.1, 381/312, 314–315; 370/344; 455/512
See application file for complete search history.

(56) References Cited

U.S. PATENT DOCUMENTS

| | | | | |
|---|---|---|---|---|
| 4,918,737 | A * | 4/1990 | Luethi | 381/315 |
| 7,142,681 | B2 * | 11/2006 | Kortekaas | 381/315 |
| 7,245,730 | B2 * | 7/2007 | Enzmann | 381/315 |
| 7,245,731 | B2 * | 7/2007 | Niederdrank et al. | 381/315 |
| 7,251,339 | B2 * | 7/2007 | Ryan | 381/315 |
| 7,283,842 | B2 * | 10/2007 | Berg | 381/315 |
| 7,330,558 | B2 * | 2/2008 | Arz et al. | 381/315 |
| 2003/0045283 | A1 | 3/2003 | Hagedoorn | |
| 2005/0071879 | A1 | 3/2005 | Haldavnekar et al. | |
| 2006/0072491 | A1 | 4/2006 | Simons | |

FOREIGN PATENT DOCUMENTS

| | | | |
|---|---|---|---|
| DE | 100 48 342 | C1 | 3/2002 |
| DE | 102 22 408 | A1 | 11/2003 |
| DE | 10323219 | B3 | 12/2004 |
| DE | 103 45 173 | B3 | 1/2005 |
| DE | 10340398 | A1 | 3/2005 |
| EP | 0 772 375 | A2 | 5/1997 |
| JP | 2003198746 | A | 7/2003 |
| JP | 2004194085 | A | 7/2004 |
| JP | 2005072764 | A | 3/2005 |
| WO | WO 2004/049631 | A1 | 6/2004 |
| WO | WO 2004/110099 | A2 | 12/2004 |

* cited by examiner

*Primary Examiner*—Suhan Ni

(57) ABSTRACT

The operation of appliances in a home network is to be made more user-friendly, for which purpose provision is made for the hearing device remote control unit to be integrated as a component in a network. This would, for example, enable warning signals triggered by the network to be provided in the hearing devices.

14 Claims, 1 Drawing Sheet

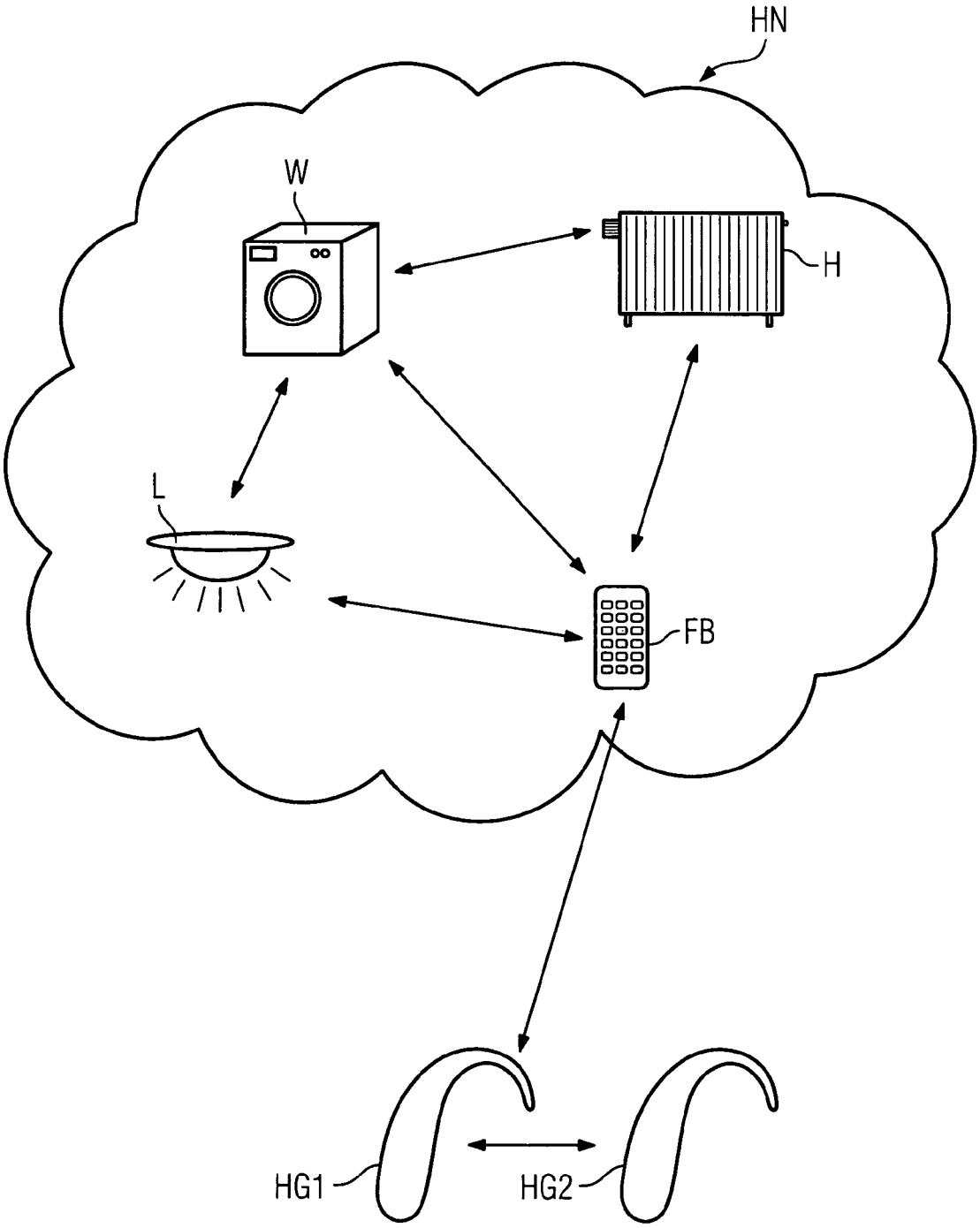
HN
W
H
L
FB
HG1
HG2

HEARING DEVICE REMOTE CONTROL UNIT AS A NETWORK COMPONENT AND CORRESPONDING USE THEREOF

CROSS REFERENCE TO RELATED APPLICATIONS

This application claims priority of German application No. 102005020315.9 filed May 2, 2005, which is incorporated by reference herein in its entirety.

FIELD OF THE INVENTION

The present invention relates to a hearing device remote control unit or relay station with a data interface for the transmission of data from/to a data network. The present invention also relates to a corresponding use of a hearing device remote control unit.

BACKGROUND OF THE INVENTION

Until now, known technical implementations of home networks or alarm systems for the hearing-impaired have been unable to communicate directly with conventional hearing device systems. Existing systems use either an additional device with an optical light signal or vibration signal in order to notify the hearing-impaired person of an event in the home or house network (doorbell, telephone, alarm clock, baby monitor or the like). Alternative systems also offer the option of establishing the acoustic connection to a hearing device via a plug-in module (MXL) or induction loop. However, MLX systems are designed as an additional module for a broadband audio transmission and are thus clearly oversized for the present signaling application, particularly with regard to power consumption and size.

Patent DE 103 45 173 B3 discloses a modular remote control unit for hearing aid devices. This remote control unit may have resources for transferring data between the remote control unit and another device other than the hearing aid device. For example, such a remote control unit may be used to establish a connection between the hearing aid device and a data network, e.g. Bluetooth or wireless LAN.

SUMMARY OF THE INVENTION

The object of the present invention is to support the transmission of information between components of a network and a hearing device.

This object is achieved according to the invention by a hearing device remote control unit or a relay station, which may be linked inductively, in particular to a hearing device, using a data interface for the transmission of data from/to a data network, said data network being a low-rated network in particular for domestic appliances. The remote control unit thus functions as an intermediary between the network and the respective hearing devices, enabling the hearing devices to participate fully in the network. A network may be a house or home network, but may also be any other local or mobile radio network. Such a network may be used for a motor vehicle, public facilities and buildings, airports, train carriages, rail stations etc.

Accordingly, the use of a hearing device remote control unit is therefore proposed for controlling one or more domestic appliances of a low-rated home network and/or for receiving data from said domestic appliance or appliances via the low-rated home network.

In contrast to existing solutions, the solution according to the invention does not require any costly additional modules for the hearing devices. The modules for connection to the home network are accommodated in the remote control unit or relay station and may therefore be operated from a battery or power pack, which is clearly more powerful than conventional hearing device batteries. The additional functions with regard to the home network connection may therefore be implemented using existing remote controllable hearing device systems with minimal requirements in terms of space and power consumption.

A further advantage of the hearing device remote control unit according to the invention or use of said hearing device remote control unit according to the invention consists in that the wearer can move freely, e.g. within the functional area of the home network (Smart Home System), and merely needs to carry the remote control unit on their person. Furthermore, the events to be reported in the home network may be flexibly defined by the user.

The data interface preferably guarantees a bidirectional connection to a low-rated network or home network. This means that the remote control unit may be used not only to call up the network, but also to control it.

According to one particular embodiment, the data interface conforms to the ZigBee standard. This defines not only the transmission format but also the data transfer rate. Furthermore, the term "low-rated" used in this document means that the data transfer rate is essentially defined according to the ZigBee standard.

According to a further embodiment, the hearing device remote control unit according to the invention has a display device for visually controlling the status of the domestic appliance or appliances. In particular, a multitude of status information reports may be reproduced via a display.

Furthermore, the hearing device remote control unit may have special operating elements for controlling the domestic appliance or appliances. This means that standard applications for controlling domestic appliances may be designed more conveniently for the hearing device wearer.

The hearing device remote control unit may also have a data processing device with which a predefinable number of statuses of domestic appliances in the home network may be checked when the user leaves the house. This means that the hearing device wearer does not need to use an additional device for checking the domestic appliances.

In a corresponding hearing device system having a hearing device and a hearing device remote control unit as described above, it may be possible for an acoustic signal to be triggered in the hearing device in response to incoming predefined data in the hearing device remote control unit. This means that the hearing device can easily be used for signaling statuses in the home network.

The type and/or sound of the acoustic signal may advantageously be varied depending on the source of the incoming data. Thus, for example, it may be possible to differentiate acoustically between signals in the home network that relate to a washing machine or an open window, etc.

BRIEF DESCRIPTION OF THE DRAWINGS

This invention will now be explained in greater detail on the basis of the attached drawing, which shows a basic sketch of a hearing device remote control unit integrated in a home network.

DETAILED DESCRIPTION OF THE INVENTION

The exemplary embodiments illustrated in greater detail below represent preferred embodiments of the present invention.

A home network HN is represented in the diagram by a washing machine W, a lamp L and a radiator H with thermostat. These devices may intercommunicate in any way via the home network HN. The home network may, for example, be a network according to the ZigBee standard, a proprietary home network or a special solution for the hearing-impaired, in which a low-rated data transmission on the scale off the ZigBee standard or below is always used.

According to the invention, a hearing device remote control unit FB with a monodirectional or bidirectional data connection to hearing devices HG1 and HG2, is integrated in the home network HN. The hearing devices HG1 and HG2 are not actually components of the home network and communicate with one another or with the remote control unit FB by means of conventional transmission technology. Since the remote control unit FB participates fully in the home network, with transmission and reception functions, the corresponding standard components of the respective home network system are integrated in it.

The remote control unit FB, as a component of the home network HN, may respond to corresponding events and may trigger a corresponding acoustic signal to alert the user, for example via a wireless digital connection to the hearing device HG1, HG2. The type and sound of this signal may be adapted to the character of the respective source L, W, H. For example, a doorbell or a telephone, which are part of a home network, may communicate with the hearing device remote control unit FB in this way. An incoming telephone call or activation of the doorbell may thus be detected by the remote control unit FB and triggers a command in the hearing device, which is announced acoustically by the respective specific signal tone in the hearing device.

In a further exemplary embodiment of the hearing device system according to the invention, a user-definable quantity of statuses is checked using the existing home network HN when the user leaves the house. Thus, for example, the system checks whether the heating, the water taps, the cooker rings and the lights are switched off. In the event of an unwanted status, this can be displayed on the remote control unit FB provided it has a corresponding display element. In addition, the hearing device wearer may also be acoustically notified of the status or statuses automatically by means of a signal tone. If the remote control unit FB also has operating elements, then the individual appliances in the home network HN may be controlled accordingly. It is also possible to provide a voice control system instead of operating elements for touch control. The microphone and transmission technology of the hearing system are used as the user interface for this purpose. Irrespective of the control type, the remote control unit is thus afforded an additional functionality—namely, in addition to the control of the hearing system, the control of the home automation system.

Instead of the remote control unit, a relay station may also be connected to the hearing devices on one side and to the home automation system on the other. Thus, for example, the relay station may be used by the home network for the inductive transmission of audio signals to the hearing device, and also in order to trigger specific signal tones in the hearing device. Status information about the home network may also be displayed on this relay station in addition.

With the remote control unit being used as the intermediary between the network and the hearing device, therefore, it is possible for the operation and monitoring of household appliances and systems to be designed more conveniently for hearing device wearers, and for the transmission of information from components in the radio network to the hearing devices to be supported.

The invention claimed is:

1. A hearing device remote control unit linked to a hearing device, comprising:

a data interface for transferring data between the hearing device and a data network wherein the interface is configured to control appliances in the network, receive signals from the appliances indicative of a status and trigger an acoustic signal in the hearing device indicative of the status.

2. The hearing device remote control unit of claim 1, wherein the hearing device remote control unit is a relay station.

3. The hearing device remote control unit as claimed in claim 1, wherein the data network complies with a ZigBee standard.

4. The hearing device remote control unit as claimed in claim 1, wherein the network is a home network.

5. The hearing device remote control unit as claimed in claim 1, wherein the data interface has a bidirectional connection to the network.

6. The hearing device remote control unit as claimed in claim 1, wherein the hearing device remote control unit controls a plurality of components in the network.

7. The hearing device remote control unit as claimed in claim 1, wherein the hearing device remote control unit has a plurality of operating elements for controlling a plurality of components in the network.

8. The hearing device remote control unit as claimed in claim 1, wherein the hearing device remote control unit has a data processing device in which a plurality of statuses of components in the network are predefined and checked when a user leaves a house.

9. A hearing device system, comprising a hearing device;

a hearing device remote control unit configured to control an appliance in a network, receive a signal from the appliance indicative of a status and provide a control signal to trigger an acoustic signal in the hearing device indicative of the status.

10. A hearing device remote control unit linked to a hearing device, comprising:

a data interface for transferring data between the hearing device and a data network;

a control unit for controlling a plurality of components in the data network;

a data processing device which receives information about a status of each in a plurality of the components in the data network and which checks the status of a component when a user leaves a house, wherein the data processing device triggers an acoustic signal in the hearing device in response to predefined status information received from one of the components.

11. The hearing device remote control unit as claimed in claim 10, wherein the hearing device remote control unit is a relay station.

12. The hearing device remote control unit as claimed in claim 10, wherein the network complies with a ZigBee standard.

13. The hearing device remote control unit as claimed in claim 10, wherein the network is a home network.

14. The hearing device remote control unit as claimed in claim 10, wherein the components in the data network are domestic appliances.

* * * * *